United States Patent [19]

Douglas

[11] 4,061,058

[45] Dec. 6, 1977

[54] LOCKING HUB TOOL

[76] Inventor: Thomas P. Douglas, 3531 E. Coolidge, Phoenix, Ariz. 85018

[21] Appl. No.: 707,851

[22] Filed: July 22, 1976

[51] Int. Cl.[2] ..... B25B 13/02; B25F 1/00

[52] U.S. Cl. ..... 81/90 C; 7/1 E

[58] Field of Search ..... 7/1 G, 1 E; 81/90 C

[56] References Cited

U.S. PATENT DOCUMENTS

| | | | |
|---|---|---|---|
| 1,384,705 | 7/1921 | Meyer | 81/90 C |
| 1,911,767 | 5/1933 | Monson | 81/90 C X |
| 2,701,707 | 2/1955 | Miller | 7/1 E |
| 3,779,106 | 12/1973 | Cavicchi | 7/1 E X |

FOREIGN PATENT DOCUMENTS

| | | | |
|---|---|---|---|
| 1,921,501 | 11/1970 | Germany | 81/90 C |

*Primary Examiner*—Al Lawrence Smith
*Assistant Examiner*—James G. Smith
*Attorney, Agent, or Firm*—H. Gordon Shields

[57] ABSTRACT

Locking hub tool apparatus is disclosed which includes a cross member and a pair of outwardly extending rods secured to the cross member for engaging opposite sides of a web of a locking hub to turn the locking hub, and the ends of the cross member are configured to provide working surfaces for the tool.

4 Claims, 6 Drawing Figures

LOCKING HUB TOOL

BACKGROUND OF THE INVENTION

1. Field of the Invention

This invention relates to tools in which a force is applied to rotate the tool in one direction or another direction, or in which a force may be applied to use a tool in other than a rotating configuration, and, more particularly, the invention relates to a tool for rotating locking hubs on four wheel drive vehicles, including tool accessories which may be employed with the vehicle hubs.

2. Description of the Prior Art

Four wheel drive vehicles typically employ hubs on the front wheels which may be engaged or disengaged, as desired. The engagement of the hubs allows the vehicle to be used with all four wheels being driven from the engine of the vehicle. The hubs may be rotated to disengage the four wheel drive and thus to allow the front wheels to be disengaged from the driving mechanism for the front wheels.

As is well known and understood in the art, a drive shaft extends to a transfer case for the front wheels of four wheel drive vehicles, and the transfer case may include different gear ratios for axles driving the front wheels. If there is but a fixed gear ratio for the front wheel drives, the transfer case simply includes provisions for engaging the drive shaft through a gear train to the axles connected to the front wheels. However, if the wheels are directly connected to the drive axles, rotation of the front wheels even with the four wheel drive disengaged from the front wheels will result in a drag on the front wheels because they are not turning freely, but rather they are engaged with, and accordingly are driving the axles to which they are connected. This early four wheel drive system has been modified by the employment of hubs which engage and disengage the front axles from the front wheels. Such hubs include the provisions for engaging and disengaging the axles and the wheels by merely rotating a portion of the hubs. With the hubs rotated in one direction, the wheels are disengaged, and with the hubs or a portion of the hubs rotated in the opposite direction, the drive is engaged.

The typical situation for hubs currently used is simply a relatively short barreled cylinder extending outwardly from the center of the front wheels, with a transverse web extending diametrically across the interior of the cylinder barrel. On either side of the transverse web, and between the web and the adjacent interior portion of the cylinder barrel is a pair of depressions which allow the user of the vehicle to insert a thumb in one depression and one or two fingers in the depression oppositely in order to rotate the hub by applying a pressure on opposite sides of the web. This rotation of the hub may become, and most typically is, a formidable accomplishment. Four wheel drive is not often required, except under off-the-road travel of such vehicles, and then even in off-the-road travel, four wheel drive is not always required. Since it is easier on the vehicle's engine and the four wheel drive system to have the four wheel drive disengaged, the vehicle is usually driven in the disengaged state. The vehicle, including the hub, and particularly the depressions in the hub, are subject to typical road problems, such as the accumulation of dust, dirt, and the like in the depressions and about the cylinder barrel as the vehicle is used. Obviously, during off-the-road driving, or even in "road" travel which may be over very bad roads, unpaved, rutted, and the like, the front wheels of the vehicle are subjected to more abuse, including dust, dirt, and the like, than with normal paved road usage.

The accumulation over a period of time in the hubs and about the hubs of such dirt, debris, and the like, may increase the difficulty in turning the hubs.

Heretofore, vehicle operators typically used the handles of a pair of pliers as a spanner wrench to aid in turning the hubs. Other makeshift type tools are also used.

The handles of the screwdriver are also used as a digging tool to dig out the dirt and debris in the depressions in the hub, so that the handles may be inserted fully into the hub. In the alternative, a screwdriver blade is used as a digging tool. Obviously, the employment of such makeshift tooling, while better than nothing, still leaves much to be desired in assisting in the turning of the hubs in the most efficient and expeditious manner.

SUMMARY OF THE INVENTION

The invention described and claimed herein comprises a tool similar to a spanner wrench with a cross member for a handle and having a pair of parallel arms or rods extending from the cross member and a pair of appropriate tools disposed at the ends of the cross member to assist in the use of the tool in locking and unlocking hubs of four wheel drive vehicles.

Among the objects of the present invention are the following:

To provide a new and useful tool;

To provide a new and useful tool for rotating locking hubs;

To provide a new and useful combination tool usable with the hubs of four wheel drive vehicles;

To provide a new and useful spanner wrench;

To provide a new and useful wrench tool in combination with appropriate coordinated tool surfaces; and To provide a combination tool including a digging surface, a blade, and a pair of rotatable arms comprising a wrench.

DESCRIPTION OF THE PREFERRED EMBODIMENT

Figure 1:
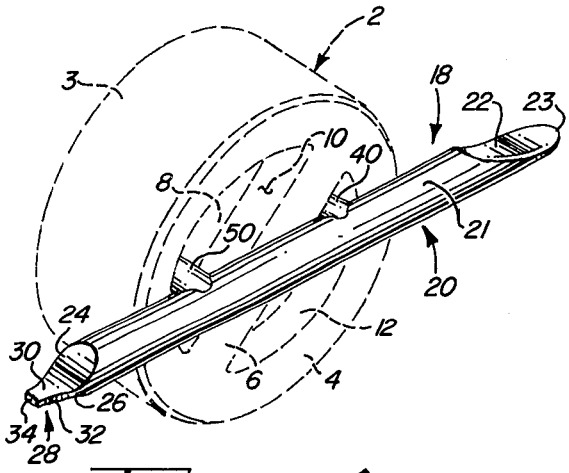
FIG. 1 is a perspective view of the apparatus of the present invention illustrated in a use environment with a hub shown in phantom.

FIG. 1 is a perspective view of the apparatus of the present invention in a use environment. A hub 2 is shown in phantom with a locking hub tool 18 inserted in the hub. The hub 2, simply illustrating a typical hub utilized on four wheel drive vehicles, is of a generally cylindrical configuration which extends outwardly from the center of a wheel. The hub 2 includes a cylinder 3 having a top surface 4 which is generally perpendicular to the axis of the cylinder 3. A web 6 extends diametrically across the cylinder and downwardly from the top surface 4 to a bottom 8. Between the web 6 and the interior of the cylindrical hub 2 are a pair of recesses 10 and 12. Each recess is defined by the bottom 8, the web 6, and the respective interior portions of the cylinder 3.

Without the use of an instrument or instruments used to rotate the hub, typically the thumb and adjacent forefinger are inserted into the recesses 10 and 12 on opposite sides of the web, and finger pressure is applied to the web to rotate the web and the hub to engage or disengage the hub. However, the size of the hub, including the recesses on opposite sides of the web, typically do not provide sufficient space and a sufficient distance for leverage purposes to enable movement of the hub to be accomplished with the ordinary pressure from the user's thumb and forefinger, particularly if the hub binds because of dirt, etc. Accordingly, the locking hub tool 18 may be employed to rotate each such hub.

The locking hub tool 18 includes a cross member 20 which is illustrated as an elongated rod of a generally circular cross-sectional configuration. At one end of the cross member 20 is a concave recess 22 which extends downwardly and forwardly from what may be arbitrarily designated as an upper portion or top 21 of the cross member 20 to a bottom portion 36 (See FIGS. 3, 5, and 6), at a relatively slight angle with respect to the longitudinal axis of the cross member 20. Accordingly, the concave recess 22 extends for a longitudinal length of the cross member 20 a distance equal to about twice the diameter of the cross member 20. The recess 22 defines a digging tool, with the surface of the recess comprising the digging surface, which extends rearwardly and upwardly from a point 23. The point 23 is at the intersection of the recess 22 and the bottom 36 at one end of the cross member 20.

On the opposite end of the cross member 20, remote from the recess 22, is a pair of concave recesses 24 and 26. The recesses 24 and 26 are on opposite sides of the cross member 20 from each other and between them they define a blade 28. The recess 24, which is illustrated as the top recess, is a more elongated recess, and extends deeper into the cross member 20, than the recess 26. The recess 26 is accordingly a more shallow recess and is not as long, axially, as the recess 24. The blade 28 also includes a pair of lateral or side recesses 30 and 32, which are on opposite sides of the blade 28 from each other, and which are generally perpendicular to the recesses 24 and 26. The blade 28 also includes a generally flat or planar point 34 which is at the intersection of the four recesses 24, 26, 30 and 32. The point is generally flat, perpendicular to the longitudinal axis of the cross member 20, and is rectangular in configuration at the intersection of the point 34 and the four enumerated recesses. The recesses 24, 26, 30, and 32, are generally concave with respect to the cross member 20.

The blade 28 may be used as an additional digging tool, if desired, or it may be used as a screw driver, as appropriate.

Extending substantially perpendicular to the cross member 20, and parallel to each other, are a pair of pins 40 and 50. The pins 40 and 50 are spaced apart along the cross member 20, to which they are appropriately secured, a distance sufficient to allow them to extend into the recesses 10 and 12 in the locking hub tool. The pins extend into the recesses 10 and 12 a maximum distance apart, on opposite sides of the web 6. They contact the web 6 as close as practical to the inner portion of the cylinder 3 of the hub 2 for maximum leverage against the web 6 and the hub 2. By applying pressure in opposite directions on opposite sides of the web 6 of the hub 2, the user of the apparatus employs the locking hub tool 18 to rotate the hub 2 into or out of engagement, as desired.

The recesses 22 and 24 on opposite ends of the cross member 20 serve an additional function from those discussed. The additional function is that of receiving a thumb or a forefinger as a thumb or finger rest against which pressure may be applied to the cross member 20 to use the apparatus in rotating the hub. The cross member 20 thus comprises a handle for the tool.

Figure 2:
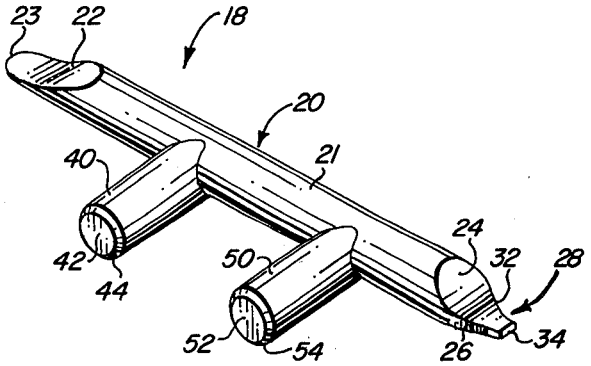
FIG. 2 is a perspective view of the tool of FIG. 1 illustrated from the opposite direction.

FIG. 2 is a perspective view of the locking hub tool 18 of FIG. 1 illustrated from the opposite direction from that shown in FIG. 1. The cross member 20 is shown, with the cylindrically configurated pins 40 and 50 extending outwardly parallel to each other and substantially perpendicular to the cross member 20. The pins 40 and 50 terminate in a pair of flat ends 42 and 52, respectively. The ends 42 and 52 are preferably perpendicular to the longitudinal axis of the respective pins. Extending circumferentially about the pins at the ends are a pair of circularly extending chamfered portions 44 and 54. The chamfers prevent a sharp edge from existing about the juncture of the cylindrical portion of the pins 40 and 50 and the perpendicular ends 42 and 52.

The concave nature of the recess 22 is illustrated, with the recess 22 extending upwardly from the point 23 to the top 21 of the cross member 20. The term "top" is used with respect to the cross member 20 to define the portion of the cylindrical cross member 20 at which the recess 22 intersects, remote from the point 23. Accordingly, the "bottom" of the cross member 20 may be defined as the portion of the cross member 20 remote from the top 21 and disposed longitudinally of the cross member 20 from the point 23.

At the opposite end of the cross member 20 from the point 23 and the recess 22, which together comprise a scoop and also a thumb or finger rest, is the blade 28. The blade 28 is defined by a pair of relieved portions or concave recesses 24 and 26, respectively extending downwardly from the top 21 and upwardly from the bottom 36 of the cross member 20. From the sides, another pair of relieved portions or recesses 30 and 32 taper inwardly toward the point 34 of the blade. The point or tip 34 is shown in FIG. 2, similarly to the way it is shown in FIG. 1, as comprising a substantially flat planar area.

Figure 3:
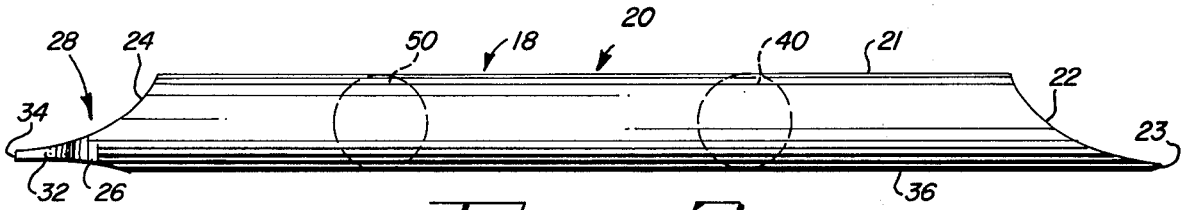
FIG. 3 is a side view of the tool illustrated in FIGS. 1 and 5.

FIG. 3 is a side view of the tool apparatus 18, showing the cross member 20 extending longitudinally. The pins 40 and 50 are shown in phantom.

At one end of the cross member 20 is the relieved portions or recess 22 and point 23, which together comprise a scoop on one end of the cross member 20. The concave configuration of the recess 22 is clearly shown extending downwardly from the top portion 21 of the cross member 20 and terminating at a point 23 at the lower or bottom portion 36 of the cross member 20.

At the opposite end of the cross member 20 is shown the blade 28. The blade is situated below the central longitudinal axis of the cross member 20, but above the bottom portion 36 of the cross member 20. The top or upper recess 24 extends concavely downwardly from the top portion 21 of the recess member 20, while the concave recess 26 extends upwardly from the bottom 36 of the cross member 20. As clearly shown in FIG. 3, the upper recess 24 is a deeper recess and a longer recess, axially, than is the lower recess 26. The recess 26 is more shallow than the upper recess 24, and does not extend along the cross member 20 axially as long as does the upper recess 24. The recess 26 may also be used as a thumb or finger hold. Accordingly, thumb and finger (hand digit) holds are always available on opposite sides of the cross member by merely turning over (inverting) the tool, depending on which way the hub is to be rotated.

Only one side recess, recess 32, is illustrated in FIG. 3. The point 34 of the blade 28 is shown at the intersection or at the termination of the recesses which define the blade 28. As indicated, the point 34 is substantially perpendicular to the longitudinal axis of the cross member 20.

Figure 4:
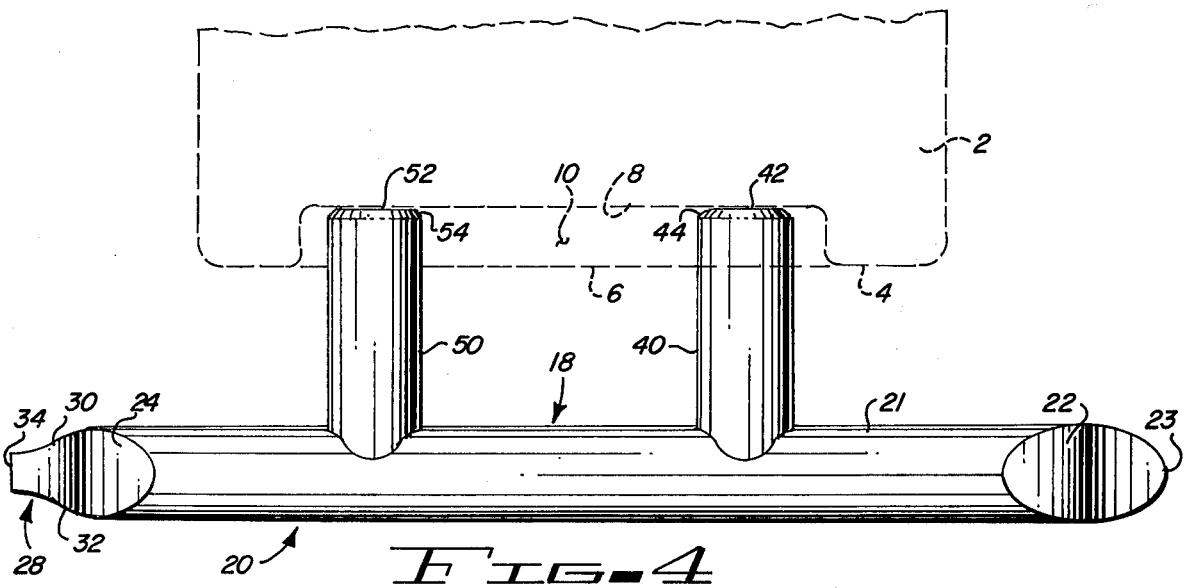
FIG. 4 is a top view of the tool of FIG. 3.

FIG. 4 is a top view of the tool 18 of FIG. 3 with the pins 40 and 50 inserted into the hub 2, which is shown in phantom. The pin 50 is shown inserted into a recess 10 in the hub 2 on one side of the web 6, while the pin 40 is shown extending into a recess on the opposite side of the web 6 in the hub 2. With the hub 2 shown in phantom, the web 6 is also shown in phantom and accordingly the recess 12 (See FIG. 1), into which the pin 40 is inserted, is not clearly illustrated in FIG. 4. With the tool 18 illustrated in its use environment in FIG. 4, the generally flat ends 42 and 52 of the pins 40 and 50 are shown disposed within their respective recesses (See also FIG. 1) and against the bottom 8 of the hub 2. The chamfers 44 and 54 of the pins are clearly shown in the top view of the pins 40 and 50.

The recess or relieved portion 22, with its point 23, are shown at one end of the cross member 20, while the blade 28 is shown in the opposite end of the cross member 20. The top or upper recess 24 of the blade 28 is shown in top view extending along the cross member 20 and terminating at the generally flat tip or point 34 of the blade 28. The two relieved portions or side recesses 30 and 32 are clearly shown in the top view of the apparatus in FIG. 4. The generally rectangular configuration of the blade 28 is shown more clearly in FIG. 4 than in any of the other views. The rectangular configuration of the blade extends rearwardly from the point 34 and from the intersection of the various recesses towards the main cylindrical portion of the cross member 20 rearwardly from the point 34. If the side recesses 30 and 32 were configured differently, or extended axially a longer length with respect to the cross member 20, the rectangular portion of the blade 28 could be lengthened. Accordingly, the length of the blade 28, or of the rectangular portion of the blade 28, may be as desired.

From FIGS. 1–4 it may readily be noted that the pins 40 and 50 extend outwardly from the cross member 20 perpendicular to the cross member itself and rotated about ninety degrees from, or perpendicular to, what has been referred to as the top 21 and the bottom 36. It may accordingly be stated that the pins 40 and 50 extend outwardly from A "side" of the cross member, with the term "side" being defined as extending between the "top" and the "bottom" of the cross member. The reason for locating the pins with respect to the top and the bottom is, of course, related to the recesses 22, 24 and 26. The recesses 22, 24 and 26 provide a dual function, as heretofore stated, and, with respect to the pins, are located perpendicular to the pins for maximum leverage as hand (or digit) holds for turning the hubs, as shown in FIGS. 1 and 4.

Figure 5:
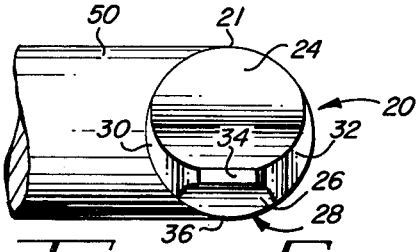
FIG. 5 is a broken end view of the tool of FIG. 4.

FIG. 5 comprises an end view of the cross member 20, with pin 50 broken away, and looking axially along the cross member 20 from the point 34 of the blade 28. The relative sizes of the recesses 24 and 26 are clearly illustrated in FIG. 5, with the upper recesses 24 extending substantially deeper or lower, with respect to the height to which the lower recess 26 extends. Accordingly, as illustrated, the point 34 is disposed not at the midpoit of the cross member 20, or on a diametrical axis with respect to the cross member 20, but rather below a diameter of the cross member 20. As explained above, one of the purposes of the recess 24 is to serve as a thumb or finger rest when using the cross member 20 as a handle to turn the pins in a hub and to thereby turn the hub itself. However, the lower recess 26 may also be used as a thumb or finger rest when rotating the tool to turn the hub. Moreover, if desired, the recesses 24 and 26 may be the same general size, which would locate the blade 28 generally on a diameter of the cross member.

The side recesses 30 and 32 are also clearly shown in FIG. 5, extending rearwardly from the generally flat, rectangular tip or point 34 to the full circumference of the cross member 20.

Figure 6:
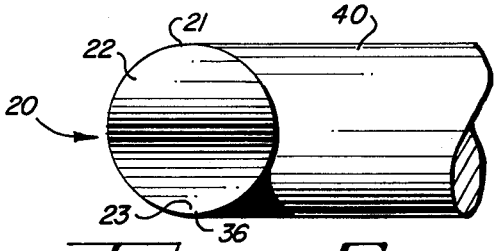
FIG. 6 is a broken end view of the opposite end of the tool of FIG. 4 from that illustrated in FIG. 5.

FIG. 6 is also an end view of the cross member 20, but taken from the opposite end of the cross member 20 from that shown in FIG. 5. The pin 40 is shown broken away in FIG. 6. The recess 22 is shown extending downwardly from the upper portion 21 of the cross member 20 to terminate in the point 23 at the bottom 36. Due to the configuration of the recess 22, comprising a smoothly concave recess extending substantially completely across the cross member 20, there is no apparent differentiation in the cross member 20 shown in FIG. 6 since there are no intersecting recesses, planes, or the like, as there are with the blade 28, as illustrated in the other figures, particularly FIG. 5.

In FIG. 6 the recess 22 appears to have a generally circular configuration, while in FIG. 4 the recess 22 appears to have a generally oval configuration. The explanation of the apparent discrepancy between the two views is obvious when one contemplates FIG. 3, comprising a side view of the cross member 20, and including a side view of the recess 22, and when one further contemplates FIGS. 4 and 6.

The cross member 20 comprises a handle which pivots about an imaginary pivot point disposed intermediate the pins 40 and 50 when a force is applied to the handle or cross member. Preferably, the force should be applied equally on opposite sides of the cross member 20 so as to rotate the handle or cross member about the pivot point. In so doing, the pins 40 and 50 apply pressure on opposite sides of a diametrically extending web in a hub (see FIGS. 1 and 4) to rotate the hub to engage or disengage the hub, and the wheel to which it is connected, to or from four wheel drive.

While the principles of the invention have been made clear in illustrative embodiments, there will be immediately obvious to those skilled in the art, many modifications of structure, arrangement, proportions, the elements, materials, and components used in the practice of the invention, and otherwise, which are particularly adapted for specific environments and operative requirements without departing from those principles. As previously indicated, while the cross member has been shown to be cylindrical in configuration, it is obvious that it may be rectangular, square, or any other appropriate shape. The pins extending outwardly from the cross member are preferably circular in configuration so as to engage easily into the depressions on opposite sides of a web in a hub. Moreover, the recesses on opposite ends of the cross member which define a scoop and a blade, are preferably concave so as to enhance the scooping action and also the use of the depressions or recesses as finger and/or thumb holds. The appended claims are intended to cover and embrace any and all such modifications, within the limits only of the true spirit and scope of the invention. This specification and the appended claims have been prepared in accordance with the applicable patent laws and rules promulgated under the authority thereof.

What is claimed is:

1. A combination tool for use with four wheel drive vehicle hubs having a pair of recesses separated by a web comprising, in combination:

handle means including a cross member having a top portion and a bottom portion and a side portion extending between the top portion and the bottom portion defining a handle and having a first end and a second end spaced apart axially from each other;

a pair of pins secured to and extending outwardly substantially perpendicular to the top portion and the bottom portion from the side portion of the cross member and spaced apart from each other and disposed substantially parallel to each other for respective insertion into the pair of recesses of the hub;

a first end on the cross member terminating at a first point and including a first recess adjacent the first point and extending upwardly from the first point to the top portion of the cross member for receiving a thumb or finger of the user for rotating the cross member and defining a scoop for cleaning the recesses of the hub for insertion of the pins into the recesses, and a second end of the cross member terminating at a second point and including a second recess adjacent the second point and extending upwardly from the second point to the top portion of the cross member for receiving a thumb or finger of the user for rotating the cross member and defining a blade for cleaning the recesses of the hub for insertion of the pins into the recesses.

2. The apparatus of claim 1 in which the handle means further includes a third recess on the second end of the cross member opposite the first recess and extending from the second point to the bottom portion of the cross member for receiving a thumb or finger of the user for rotating the cross member.

3. The apparatus of claim 2 in which the handle means further includes a fourth and a fifth recess at the second end of the cross member opposite each other and generally perpendicular to the second and third recesses and defining, with the second and third recesses, a blade for use in cleaning the hub.

4. The apparatus of claim 3 in which the first recess on the first end of the cross member and the second and third recesses on the second end of the cross member are generally concave in configuration.

* * * * *